United States Patent [19]

Wakim

[11] 4,134,845

[45] Jan. 16, 1979

[54] SULPHURIZED MATERIAL AND A LUBRICANT COMPOSITION

[75] Inventor: Jamil M. Wakim, Burlington, Canada

[73] Assignee: Shell Oil Company, Houston, Tex.

[21] Appl. No.: 858,137

[22] Filed: Dec. 7, 1977

[30] Foreign Application Priority Data

Dec. 14, 1976 [CA] Canada ..... 267827

[51] Int. Cl.[2] ..... C10M 1/38; C10M 3/32; C10M 5/28; C10M 7/36

[52] U.S. Cl. ..... 252/48.6

[58] Field of Search ..... 252/48.6; 72/42

[56] References Cited

U.S. PATENT DOCUMENTS

| | | | |
|---|---|---|---|
| 3,740,333 | 6/1973 | Hutchinson et al. | 252/48.6 |
| 3,850,825 | 11/1974 | Vienna et al. | 252/48.6 |
| 3,986,966 | 10/1976 | Wakim | 252/48.6 |
| 4,036,769 | 7/1977 | Zipf | 252/48.6 |

*Primary Examiner*—Delbert E. Gantz
*Assistant Examiner*—Irving Vaughn
*Attorney, Agent, or Firm*—Ronald R. Reper

[57] ABSTRACT

Sulphurized material suitable as an extreme pressure additive for lubricants is obtained by sulphurizing (a) at least one of (1) inedible tallow oil and (2) an alcoholysis product of (1), or (b) a mixture of (a) and an ester of an unsaturated fatty acid having 12–30 carbon atoms and an alkanol, said ester being different from said alcoholysis product.

7 Claims, No Drawings

SULPHURIZED MATERIAL AND A LUBRICANT COMPOSITION

BACKGROUND OF THE INVENTION

This invention relates to a sulphurized material suitable as a substitute for sulphurized sperm oil, which is a well-known and very effective extreme pressure and anti-wear additive for lubricants. Owing to whale protection laws, sperm oil is rapidly diminishing in availability.

The purpose of this invention is to find a substitute for sulphurized sperm oil while avoiding the use of edible oils. It has been found that inedible tallow oil or alcoholysis products thereof are excellently suitable for this purpose.

SUMMARY OF THE INVENTION

This invention therefore relates to a sulphurized material obtained by sulphurizing (a) at least one of (1) inedible tallow oil and (2) an alcoholysis product thereof, or (b) a mixture of (a) and an ester of an unsaturated fatty acid having 12–30 carbon atoms and an alkanol which ester is different from said alcoholysis product and/or a triglyceride different from inedible tallow oil, and to lubricant compositions comprising this sulphurized material.

DESCRIPTION OF PREFERRED EMBODIMENTS

The inedible tallow oil is preferably obtained by dissolving inedible tallow in a selective solvent, cooling the solution to a suitable temperature, filtering and evaporating the solvent from the filtrate. The selective solvents include e.g. ketones such as acetone, methyl ethyl ketone, etc., alkanes such as pentane, hexane, etc., and low molecular weight esters, such as methyl acetate, ethyl acetate, etc. The range of suitable temperatures depends on the desired iodine value of the tallow oil. For iodine values of 65–75, suitable temperatures may range from about 0 to about −25° C.

The solvent can also be evaporated from the solid phase, which results in a high quality inedible tallow similar to the acidless tallow normally used in e.g. the petroleum industry.

The inedible tallow is preferably purified to remove extraneous materials and to reduce the free fatty acid content. Suitable purification methods include extraction with a lower alcohol having e.g. 1–5 carbon atoms. Methanol is particularly suitable. Another suitable method is that of neutralizing the free fatty acids with alkali and removal of the soaps produced, by conventional techniques such as filtration, centrifugation, etc. The neutralization step can be performed on the tallow, as received, or as a solution in a selective solvent.

The alcoholysis product of the inedible tallow oil is preferably obtained by transesterification of inedible tallow oil with an alkanol having 1–30 carbon atoms. Alkanols having 1–5 carbon atoms are preferred and methanol is particularly preferred.

The sulphurized material of this invention may contain an ester of an unsaturated fatty acid having 12–30 carbon atoms and an alkanol, suitably an alkanol having from 1–30 preferably 1–5 carbon atoms; methanol is preferred. A suitable unsaturated fatty acid is oleic acid. Esters of mixtures of unsaturated acids and/or of mixtures of alkanols are also suitable.

Very suitable esters of this type are the alcoholysis products of triglycerides different from inedible tallow oil.

It is obvious to those skilled in the art that suitable esters can also be prepared by the direct reaction of an alkanol and a free fatty acid under conventional esterification conditions.

Preferred triglycerides have an iodine value of 70–120 g/100 g. Suitable triglycerides are rapeseed oil, canbra oil (a variety of rapeseed oil), lard oil, peanut oil, safflower oil, cotton seed oil and neatsfoot oil. Soya bean oil, having an iodine value around 140 can also be used.

A preferred sulphurized material is obtained by sulphurizing a mixture of inedible tallow oil and the alcoholysis product thereof and/or the alcoholysis product of a triglyceride different from inedible tallow oil. A particularly preferred sulphurized material is obtained by sulphurizing mixtures of oil and esters as described in (a) and (b) above, either oil or ester or both being derived from inedible tallow oil; the weight ratio of oil to ester may vary from 90:10 to 10:90 but a preferred ratio is from 70:30 to 30:70.

Mixtures of esters and/or triglycerides can also be used.

Although the sulphurized material is preferably obtained by cosulphurizing the ingredients in question, it can in principle also be obtained by mixing the sulphurized ingredients.

It has been found that this sulphurized material can be very effective as a relatively inexpensive substitute for sulphurized sperm oil in lubricant compositions. In particular the co-sulphurized mixtures containing 30:70% inedible tallow oil described above have favorable properties, in that they do not alter the pour points and the low temperature viscosities of the lubricants appreciably.

Suitable lubricant compositions are e.g. lubricating oils such as gear oils, metal working fluids, tableway oils, hydraulic oils and lubricating greases, such as soap-, clay- or organic greases.

Suitable proportions of said sulphurized material, are 0.1–20%w, preferably 1–10%w, based on the final composition.

The lubricating oil is preferably a mineral lubricating oil although synthetic hydrocarbon lubricating oils and other synthetic lubricating oils, such as ester oils as well as mixtures thereof, e.g. mixtures of mineral and synthetic oils, can also be used provided that the desired proportion of the present mixture can be solved in the base oil in question.

The mineral oils include HVI (high viscosity index) oils, Bright Stock, Bright Stock extracts as well as MVI (medium viscosity index) and LVI (low viscosity index) oils, i.e. the viscosity index of these oils can vary from −150 to 150. The 210° F. viscosities of these oils can vary from 2 to 140 centistokes. Hydrogenated oils can also be used.

Other additives may be present, such as anti-oxidants, anti-corrosion agents, anti-foam agents, pour point depressants and additional anti-wear or load-carrying additives.

The sulphur content of the sulphurized materials of this invention is suitably between 1 and 40%w, preferably between 5 and 30%w, e.g. about 10%w. The sulphur can be active and/or inactive depending on the method of preparation. This preparation includes heating with sulphur as well as reacting with sulphur-containing compounds, such as sulphur mono- or dichloride and phosphorus pentasulphide.

EXAMPLES 100 pbw inedible tallow oil having an acid number of 7.2 mg KOH/g and an iodine value of 62 was dewaxed with acetone at 0° C. which resulted in 58.0 parts by weight (pbw) tallow oil having an acid number of 10.8 mg KOH/g and an iodine value of 75 and 42.0 pbw solid phase having an acid number of 2.6 and an iodine value of 42.

107.5 pbw inedible tallow was extracted with methanol which resulted in 100 pbw inedible tallow having an acid number of 1.1 mg KOH/g and an iodine value of 56. Dewaxing with acetone at 0° C. resulted in 44.1 pbw tallow oil having an acid number of 1.9 mg KOH/g and an iodine value of 72 and 55.9 pbw solid phase having an acid number of 0.6 mg KOH/g and an iodine value of 30.

Mixtures containing this methanol extracted tallow oil or the methyl ester prepared therefrom were sulphurized to a sulphur content of 9.5%w and 5%w of the sulphurized products were added to a SAE 90 lubricating oil. The results are indicated in the following table.

A 5%w solution of sulphurized sperm oil, sulphur content 9.5%w, in the same base oil, showed a Timken OK Load of 40 lbs. and a 4-Ball Wear Scar Diameter of 0.63 mm.

TABLE

| | 1 | 2 | 3 | 4 | 5 |
|---|---|---|---|---|---|
| Ester, Ratio %wt. (all as methyl esters) | Canbra 55 | Tallow 55 | Tallow 55 | Tallow 55 | — |
| Oil, Ratio %wt. | Tallow 45 | Canbra 45 | Tallow 45 | Soya 45 | Tallow 100 |
| Sulphur Content, %wt. | 9.5 | 9.5 | 9.5 | 9.5 | 9.5 |
| Viscosity at 100° F, cst | 94.2 | 147 | 71.0 | 110 | 2040 |
| Properties of 5% Solution in SAE 90 Base Oil | | | | | |
| Timken OK Load, lbs. | 50 | 45 | 50 | 45 | 35 |
| 4-Ball Wear, scar Diameter, mm | 0.54 | 0.54 | 0.57 | 0.54 | 0.53 |
| CCS Visc. at 0° F, poise | 185 | 204 | 204 | 199 | 215 |
| RBOT Life, Min. ASTM D-2272 | 315 | 365 | 355 | 280 | 305 |
| Pour Point, ° F | 5 | 15 | 15 | 15 | 0 |

| | 6 | 7 | 8 | 9 |
|---|---|---|---|---|
| Ester, Ratio %wt. (all as methyl esters) | Tallow 100 | Tallow 30 | Tallow 70 | Soya 55 |
| Oil, Ratio %wt. | — | Tallow 70 | Tallow 30 | Tallow 45 |
| Sulphur Content, %wt. | 9.5 | 9.5 | 9.5 | 9.5 |
| Viscosity at 100° F, cst | 18.1 | 179 | 55.1 | 96.2 |
| Properties of 5% Solution in SAE 90 Base Oil | | | | |
| Timken OK Load, lbs. | 40 | 35 | 50 | 40 |
| 4-Ball Wear, scar Diameter, mm | 0.55 | 0.55 | 0.55 | 0.54 |
| CCS Visc. at 0° F, poise | 177 | 204 | 199 | 177 |
| RBOT Life, Min. ASTM D-2272 | 235 | 260 | 255 | 245 |
| Pour Point, ° F | 15 | 5 | 10 | 5 |

What is claimed is:

1. A sulphurized material obtained by:

(a) dissolving inedible tallow in a selective solvent, cooling, filtering and evaporating the solvent from the filtrate, to obtain an inedible tallow oil, (b) mixing the product of step (a) in a weight ratio of between 70:30 and 30:20 with the alcoholysis product of step (a) obtained by use of an alkanol having 1–30 carbon atoms in a weight ratio of between 70:30 and 30:70 oil to alcoholysis product resulting in mixed starting material, and (c) sulphurizing said mixed starting material to obtain a sulphurized material having a sulphur content between 5 and 30%w.

2. A material as in claim 1 wherein at least part of the alcoholysis product in step (b) is replaced with an ester of an unsaturated fatty acid having 12–30 carbon atoms and an alkanol, which ester is different from said alcoholysis product.

3. A material according to claim 2, wherein the ester component is an alcoholysis product of a triglyceride different from inedible tallow.

4. A material according to claim 2, wherein the mixture contains in addition a triglyceride different from the inedible tallow oil said triglyceride having an iodine value of 70–120 g/100 g.

5. A material according to claim 4, wherein the triglyceride is soya bean oil.

6. A material according to claim 1, wherein the selective solvent is acetone.

7. A lubricant composition comprising a major amount of an oil of lubricating viscosity and from about 0.1–20% by weight of a material according to claim 1.

* * * * *